US006200452B1

(12) United States Patent
Angelini

(10) Patent No.: US 6,200,452 B1
(45) Date of Patent: Mar. 13, 2001

(54) METHOD AND APPARATUS FOR THE CONTINUOUS CHROMIUM-PLATING OF ELONGATED MEMBERS

(76) Inventor: Giovanna Angelini, Via Vittorio Veneto 42, 20047 Brugherio (MI) (IT)

( * ) Notice: Subject to any disclaimer, the term of this patent is extended or adjusted under 35 U.S.C. 154(b) by 0 days.

(21) Appl. No.: 09/452,163

(22) Filed: Dec. 1, 1999

(30) Foreign Application Priority Data

Dec. 1, 1998 (IT) ..... MI98A2595

(51) Int. Cl.[7] ..... C25D 7/04

(52) U.S. Cl. ..... 205/151; 205/243; 205/283; 205/284; 204/198; 204/203; 204/206; 204/207; 204/210; 204/225; 204/232; 204/237; 204/239; 204/269

(58) Field of Search ..... 205/151, 243, 205/283, 284; 204/198, 203, 206, 207, 210, 225, 232, 237, 239, 269

(56) References Cited

U.S. PATENT DOCUMENTS

| | | | |
|---|---|---|---|
| 3,751,344 | 8/1973 | Angelini | 204/28 |
| 3,852,170 | 12/1974 | Angelini | 204/210 |
| 4,419,194 | 12/1983 | Angelini | 204/206 |
| 4,466,618 | 8/1984 | Angelini | 204/28 |
| 4,518,474 * | 5/1985 | Podrini | 204/206 |
| 4,832,811 * | 5/1989 | Hosten | 204/198 |
| 4,986,888 * | 1/1991 | Hosten et al. | 204/198 |
| 5,176,808 * | 1/1993 | Byler et al. | 204/206 |
| 5,401,379 * | 3/1995 | Mazzochi | 205/283 |
| 5,476,577 * | 12/1995 | May et al. | 204/206 |
| 5,695,621 * | 12/1997 | Pop et al. | 204/225 |
| 5,786,556 * | 7/1998 | Grönlund et al. | 204/206 |

FOREIGN PATENT DOCUMENTS 0 259 922 3/1988 (EP) .

* cited by examiner

*Primary Examiner*—Bruce F. Bell
(74) *Attorney, Agent, or Firm*—Young & Thompson

(57) ABSTRACT

A method and an apparatus for the continuous chromium-plating of elongated members such as bars and the like: the bar to be plated is fed and rotated through at least one tubular shaped chromium-plating anode into which an electrolytic solution suitable for depositing a layer of chromium on the bar, as the latter advances through the said anode, is supplied. The electrolytic solution is supplied into the anode from the bottom upwards, through sets of holes over the bottom and the upper surfaces of the anode; the bottom holes communicate with a pressure balancing and flow distribution chamber for the electrolytic solution. This results in an electrolytic flow upwardly directed in a perpendicular direction to the longitudinal axis of the bar, the temperature of which may be controlled by changing the flow rate of the electrolytic solution circulating inside the anode.

28 Claims, 5 Drawing Sheets

METHOD AND APPARATUS FOR THE CONTINUOUS CHROMIUM-PLATING OF ELONGATED MEMBERS

BACKGROUND OF THE INVENTION

The present invention relates to hard chromium-plating of elongated metal members such as bars, tubular elements and the like, which are generally referred to below as "bars", and more generally relates to a method and to an apparatus for the continuous electrolytic chromium-plating of bars with high-speed circulation of the electrolytic fluid, while the bars are fed through one or more chromium-plating anodes.

STATE OF THE ART

The currently known chromium-plating plants generally comprise a long chromium-plating anode, of varying shape, which is totally immersed into an electrolytic bath within a large chromium-plating tank capable of containing 1000–3000 or more liters of electrolytic solution, through which the bars to be plated are continuously advanced at a constant working speed; sealing sleeves or special gaskets prevent the liquid escaping from the chromium-plating bath in the region of through-openings for the bars specially provided at the opposite end walls of the tank.

The electrolytic solution is continuously or periodically renewed, by causing it to recirculate between the chromium-plating tank in which the anode is immersed and an additional tank separately arranged or containing the same chromium-plating tank.

In general the chromium-plating anode is totally immersed in the electrolytic solution, while maintaining substantially static conditions of the bath, both in the tank and inside the chromium-plating anode, with respect to the advancing bar to be plated.

Examples of chromium-plating apparatus of the kind mentioned above may be found, for example, in U.S. Pat. Nos. 3,751,344, 3,852,170, 4,419,194 and 4,466,618.

As already mentioned, in the apparatus known from the abovementioned patents large quantities of electrolytic solution are required in the chromium-plating bath, resulting in a high energy consumption in order to keep the electrolytic solution at the required temperature for chromium-plating each specific type of bar.

Moreover, in these apparatus of the known type, both owing to the substantially static condition of the chromium-plating bath, and to the dimensions of the anode and the chromium-plating tank, it is not possible to achieve precise control of the chromium deposition onto the bar as it advances, resulting therefore in a unhomogeneous depositing of chromium, and formation of deep cracks.

Finally, in chromium-plating apparatus of the known type, owing to the static condition of the chromium-plating bath, as well as the immersed disposition of the anode, it is possible to supply the latter only with low current densities, equal to or less than 30–50 A/dm$^2$; all this limits the speed of advancing the bars through the chromium-plating anode, thereby conditioning the productivity of the plant.

Consequently, a conventional chromium-plating plant, in addition to being bulky and difficult to manage, is characterized by an extremely low productivity as a result of its constructional and functional characteristics.

In order to partly overcome these and other drawbacks, EP-A-0,259,922 suggests recirculating the electrolytic solution between a tank containing the chromium-plating bath, and the anode while maintaining inside the chromium-plating anode a flow direction which is substantially parallel to the longitudinal axis of the same anode and the bar to be plated.

According to certain embodiments illustrated in this document, the electrolytic solution is supplied from one end of the anode and discharged into a tank from the opposite end of the anode, so as to obtain the desired axial flow.

According to another embodiment, it is envisaged using a long anode supplied with electrolytic fluid at both its ends and provided, at the top with a central opening through which the electrolytic solution over flows, being collected in an underlying container.

According to a third embodiment, the electrolytic solution is supplied centrally to the anode and discharged into the tank at the two opposite ends of the said anode.

In all cases, therefore, there inside the chromium-plating anode, one or more axial flows of electrolytic solution will exist which move in the same direction or in the opposite direction of and parallely to the advancing bar.

Such a solution has proved to be unsuitable for the hard chromium-plating of bars since it does not provide homogeneous and constant temperature conditions of the bath over the entire length of the anode; in particular the flow of electrolytic solution which flows axially through the chromium-plating anode, tends gradually to heat up, being in contact with the bar over the entire length of the anode, thus involving non-uniform chromium-plating and chromium-deposition conditions over the whole length of the bars to be plated. Finally, owing to the impossibility of maintaining constant temperature conditions of the chromium-plating solution inside the anode, due to the considerable length of the latter, of about two or three meters, with these apparatus of the known type also, it is difficult or impossible to operate with high densities of the chromium-plating current and consequently increase the speed of the bars and the productivity of the plant.

OBJECTS OF THE INVENTION

The main object of the present invention is to provide a method and an apparatus for the continuous chromium-plating of bars, tubular elements or elongated members and the like, by means of which it is possible to adequately control the temperature of the bar in the chromium-deposition zone, or inside the anode, using the same electrolytic solution flowing through the anode to keep the bar temperature at a substantially constant and uniform suitable value over the whole length of the anode, which may be substantially reduced in respect to the anodes of known plants. In this way it possible to operate with current densities of about 150–400 A/dm$^2$ which are much higher than those of conventional apparatus, namely increase considerably the operating speed of the same plant.

A further object of the present invention is to provide a method and an apparatus for the continuous chromium-plating of bars by means of which it is possible to obtain uniform and controllable chromium-deposition conditions, over the whole length of the anode or chromium-plating zone.

A further object is to provide a method and an apparatus of the type defined above, by means of which it is possible to deposit several superimposed layers of chromium by a single pass of the bar through several anodes, while maintaining suitably controlled chromium-plating conditions.

Yet another object of the invention is to provide a chromium-plating method and an apparatus comprising several chromium-plating anodes in which the chromium-plating conditions of the bar in each anode may be varied and/or individually controlled, independently of the chromium-plating conditions in the other anodes of the same apparatus.

Another object of the invention is to provide a improved chromium-plating method and an apparatus both from the point of view of the quality of the chromium-plating obtained and from the costs and the time required to complete a chromium-plating operation of a bar having the required thickness of chromium layer or layers plated on the bar.

BRIEF DESCRIPTION OF THE INVENTION

The general principle which forms the basis of the present invention and which is substantially distinguishing from the chromium-plating methods and apparatus previously known resides in the use of a particular chromium-plating anode structure performing both the function of a container for a required quantity of the electrolytic solution which is necessary for chromium-plating and which may be continuously renewed by causing it to circulate at high speed as the bar is advanced longitudinally inside the anode itself, and the distributor function of the electrolytic flow solution inside the anode, as well as an effective control means for maintaining controlled and uniform temperature conditions of the bar during the entire chromium-plating process.

Therefore, according to a first aspect of the present invention, a method for the continuous chromium-plating of elongated members, such as metal bars, tubular elements and the like has been provided, according to which an elongated member to be plated is advanced through at least one tubular-shaped chromium-plating anode into which an electrolytic solution is made to flow so as to allow the deposition of at least a layer of chromium on the bar as the latter is advanced through the anode, characterized by the steps of:

supplying the electrolytic solution along the length of the chromium-plating anode by axially distributing a flow of electrolytic solution from the bottom to upwards, transversely with respect to the advancing direction of the elongated member, and circulating the electrolytic solution through the chromium-plating anode, in a controlled condition and in a quantity sufficient for keeping the elongated member at a substantially constant chromium-plating temperature while the same elongated member is advanced into the electrolytic solution along the chromium-plating anode.

According to another aspect of the invention, both upstream and downstream of the chromium-plating anode or anodes, the elongated member to be plated is thermally conditioned to a suitable temperature for improving the chromium-plating process, cooling the same elongated member by suitable impinging air jets.

According to a further aspect of the invention, the chromium-plated member is further cooled upon leaving the chromium-plating apparatus by washing and air jets and/or by immersing the same elongated member in the water contained into a cooling tank.

According to another aspect of the invention, an apparatus for the continuous chromium-plating of elongated members such as bars, tubular elements and the like, has been provided, characterized by comprising:

a chromium-plating chamber longitudinally extending in a moving direction of the elongated members to be plated, said chamber having opposite side walls provided with aligned openings for the passage of the elongated member;

at least one tubular anode axially aligned with the inlet and outlet openings for the passage of the elongated member provided at the opposite side walls of the chromium-plating chambers;

an auxiliary tank containing a fresh electrolytic chromium-plating solution;

electrolytic solution supplying means for axially distributing the electrolytic solution by transversely flowing the solution with respect to the chromium-plating anode, while maintaining a flow direction inside the anode from the bottom upwards; and temperature control means for maintaining the elongated member at a uniform and substantially constant chromium-plating temperature, over the length and inside the said chromium-plating anode.

According to another aspect of invention, an apparatus of the kind defined above has been provided, said apparatus being provided with additional cooling means for the elongated member, comprising air jets impinging the elongated member close to the inlet and the outlet openings for the elongated member at opposite walls of the chromium-plating chamber.

The apparatus is also provided, with a set of axially aligned anodes having a reduced length, for example comprised between 30–40 cm; furthermore, immediately upstream the anode or anodes, the chromium-plating chamber is provided with suitable means for performing a surface corrosion treatment or mordanting of the elongated member by means of the same electrolytic solution, which is sprayed against the moving member with a pressure variable according to the nature of the material to be treated.

BRIEF DESCRIPTION OF THE DRAWINGS

These and further features of the method and the apparatus according to the invention, as well as some preferred embodiments thereof, will emerge more clearly from the following description making reference to the accompanying drawings, in which.

DETAILED DESCRIPTION OF THE INVENTION

Figure 1:
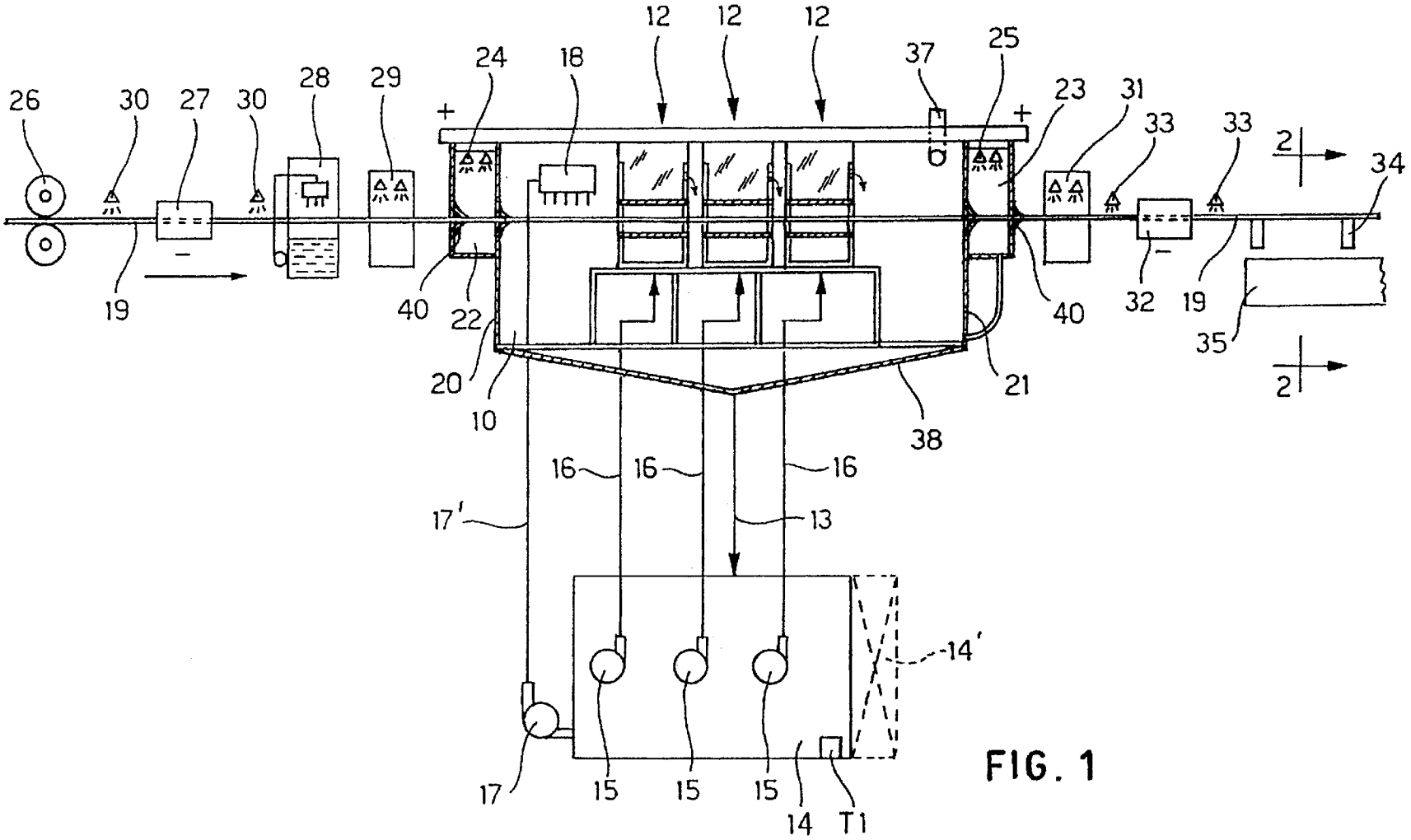
FIG. 1 shows a general diagram of an apparatus suitable for the continuous chromium-plating of bars according to the invention.

With reference to FIG. 1 we shall describe the general features of the method and the apparatus according to the invention.

As shown in said figure, the apparatus comprises a chromium-plating chamber 10 having bottom and side walls for collecting an electrolytic solution which flows out, for example, from three chromium-plating anodes 12 inside the chamber itself, so as to be conveyed by a piping 13 to a storage tank 14 containing a quantity of fresh electrolytic solution sufficient for supplying and a continuous renewal of the electrolyte inside the electrodes 12 of the chromium-plating apparatus. The electrolyte solution contained in the storage tank 14 is kept at a constant temperature, suitable for chromium-plating, which is sensed by a temperature control means such as a thermometer T1 and a heat exchanger 14', which intervenes to keep the electrolyte inside the tank 14 at a prefixed constant temperature. The chamber 10, on one or more side walls, is provided with a large aperture or window closed by a transparent sheet material, for viewing the whole process and the chromium-plating of the bars; suitable water jets keep the window free from any splashes of electrolyte.

The chromium-plating solution is supplied into each anode 12, by a respective feeding pump 15 and a delivery piping 16, while an auxiliary pump 17 and a delivery piping 17' supply the electrolytic solution to a spraying head 18, located upstream of the chromium-plating anodes 12, inside the chamber 10 so as to cause, by means of the said electrolytic solution, a slight surface corrosion of the bar 19 which will improve adhesion of the chromium during the electrolytic deposition via the anodes 12, in the manner explained further below.

The chromium-plating chamber 10, in the region of its end walls 20 and 21 having inlet and outlet apertures for the bars, is provided with a closed interspace 22 and 23 to contain jets 24 and 25 of wetted air, at the ambient or at a cooled temperature, suitable for cooling the bars 19 both on the inlet and on the outlet sides, while keeping it at a prefixed constant temperature suitable for chromium-plating, for example at a temperature comprised between 50 and 70° C., preventing the bars 19 from overheating owing to the heating effect of the current flowing along the bar itself.

Upstream of the chromium-plating tank 10, the apparatus comprises a rollerway 26 for supporting the bars 19, as schematically shown, by means of which the bars 19 which are suitably connected together by intermediate joint members, are forwards advanced and at the same time made to axially rotate so as to improve the uniformity of the chromium deposition onto the bar which advances through the chromium-plating anodes 12.

Upstream the chamber 10 a first electrical connector of the slide contact type, device 27 is provided for connecting the bars 19 to the negative pole of a DC electric power source, for example copper braids which are wound around the bar, or a mercury type contactor or the like, as well as a degreasing tank 28, described further below with reference to FIG. 6, and a water rinsing tank 29 for eliminating any trace of solvent and/or degreasing surfactant before the bars enter the plating chamber 10.

Reference 30 in FIG. 1 also denotes air jets for cooling the bars 19 in the region of the sliding electrical connector 27.

Downstream of the chromium-plating chamber 10, immediately after the outlet side for the bars 19, there is provided a washing device 31, a second sliding-connector device 32, air jets 33, as well as a second rollerway 34 suitable for supporting the outgoing chromium-plated bars, allowing them to be disengaged each others for their introduction into a cooling tank 35 containing water, as explained below with reference to FIG. 2.

Figure 2:
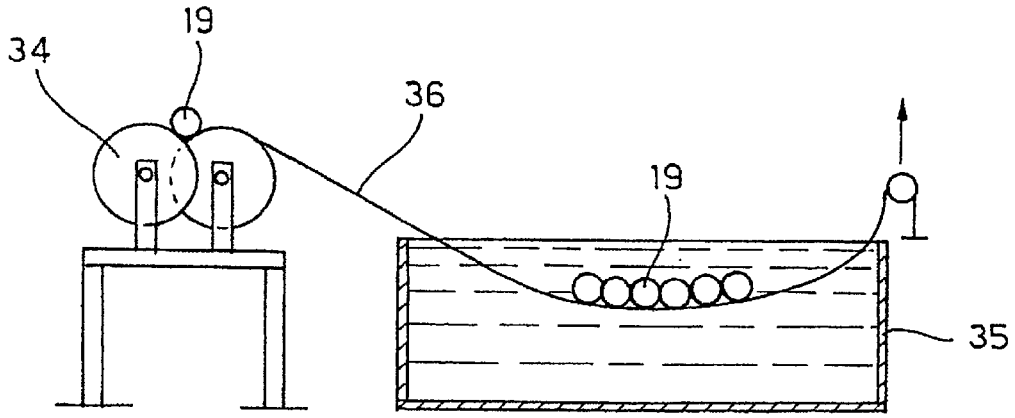
FIG. 2 is a detail, on a larger scale, illustrating a cooling tank for the plated bars in an apparatus according to FIG. 1.

In fact, as can be seen from FIG. 2, on the side of the exit rollerway 34, there is provided the water cooling tank 35 into which the chromium-plated bars 19 are made to fall in each case along a chute consisting for example of a fabric sheet 36; the chromium-plated bars 19 are kept in the water bath for a sufficient period of time to be cooled to a temperature of about 50–70° C., suitable for subsequent finishing treatment with highly-inoxidisable liquid or solid materials.

Figure 5:
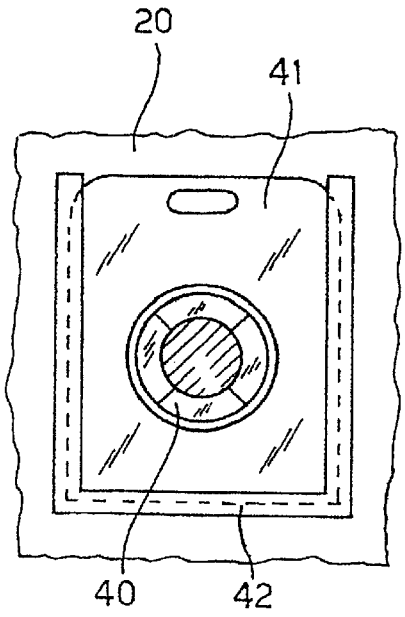
FIG. 5 is a detail according to FIG. 1 relating to the sealing system provided in the region of the inlet and outlet openings for the bars.
Figure 6:
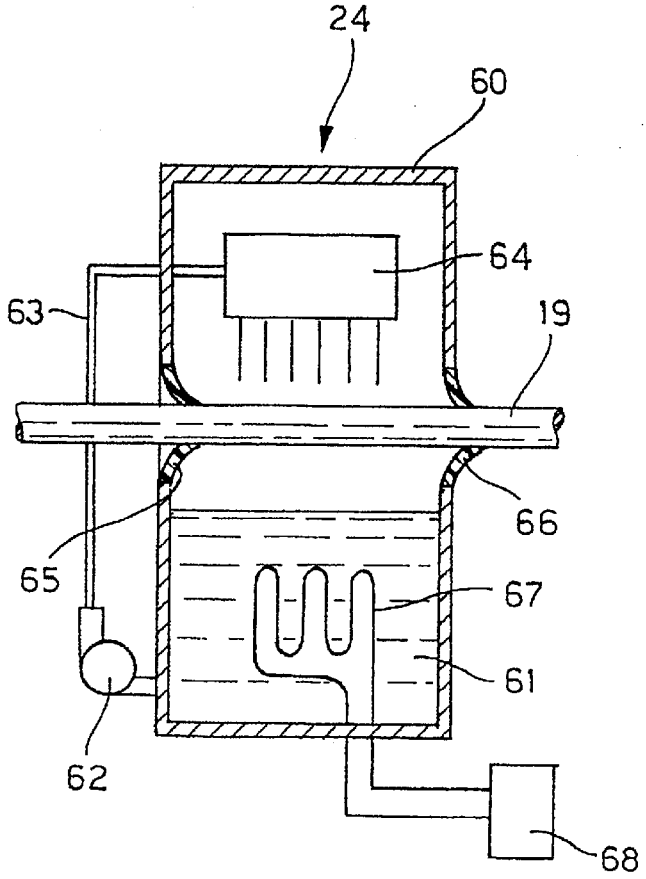
FIG. 6 is a detail, on a larger scale, of an apparatus for degreasing the bars in a chromium-plating apparatus according to FIG. 1.

With reference to FIGS. 1, 5 and 6, further features of the chromium-plating chamber 10 and the apparatus according to the invention will be now described; as shown, the chamber 10 is totally closed by peripheral walls so as to prevent vapours of the electrolytic solution from escaping; in this connection, the upper side of the chromium-plating chamber 10 is connected to an air suction device by means of a piping 37.

The chromium-plating chamber 10 also has a bottom wall 38 which is slanted towards the centre and on which the electrolytic solution flowing out from the chromium-plating electrodes 12 is collected; it also comprises front and rear end walls 20, 21 provided with large openings which are axially aligned to allow the bars 19 to pass through. Axially aligned openings are also formed in the front walls of the interspaces 22 and 23.

Each of the through-openings for the bars, in the walls of the interspaces 22, 23 and the chamber 10, as shown in FIG. 5, is provided with a suitable sealing means in the form of a flexible gasket 40, which is designed to allow the bars 19 to pass through, ensuring a sufficient sealing action for preventing the chromium-plating solution from escaping to the outside.

Since the apparatus must be suitable for treating bars or elongated pieces of different diameter or cross-sectional area, the sealing gaskets 40, as shown in the example according to FIG. 5, are mounted on a gate member 41 sliding in suitable guides 42 on the inner side and on the outer side, respectively, of the walls of the chamber 10 and the interspaces 22 and 23.

In this way it is possible to remove the gate 41 with the respective gasket 40, replacing it with another one suitable for receiving and sealing a bar having a different diameter or cross-section.

Figure 3:
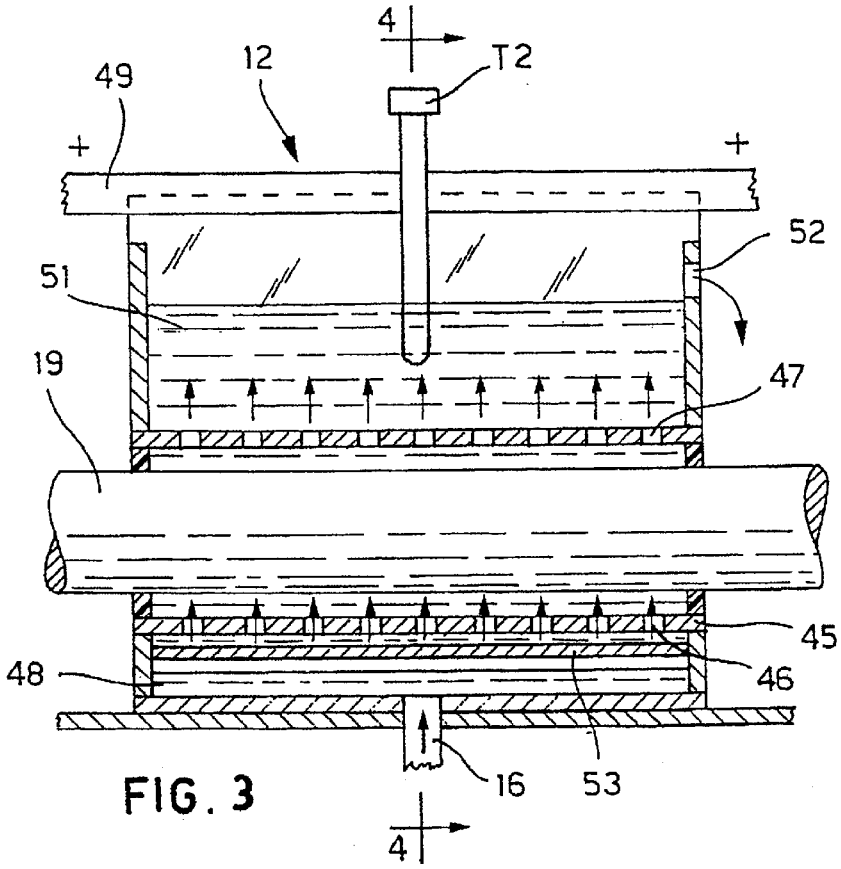
FIG. 3 shows a view, on a larger scale, of an embodiment of an anode structure according to the invention.
Figure 4:
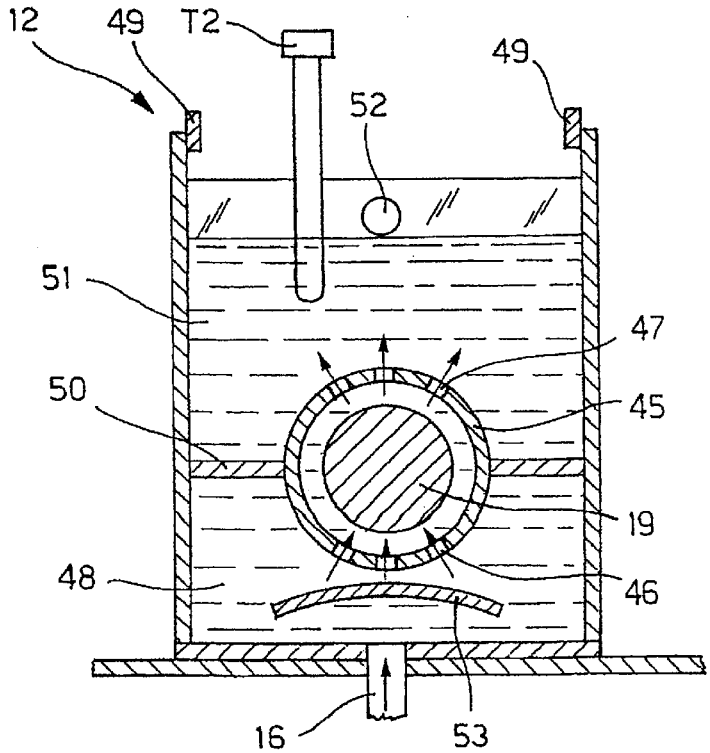
FIG. 4 is a cross-sectional view, on a larger scale, along the line 4—4 of FIG. 3.

With reference now to FIGS. 3 and 4 we shall describe in greater detail the features of the chromium-plating anode according to the present invention.

As can be noted from the abovementioned figures, the structure of the chromium-plating anode, indicated in its entirety by 12, comprises a tubular element 45 which extends longitudinally in the direction of travel of the bars 19.

The tubular element 45 of the chromium-plating anode has, on its bottom surface, a plurality of holes 46 for entry of the electrolytic solution, for example three sets of holes uniformly distributed substantially over the whole length of the anode 12.

Correspondingly, the upper wall of the tubular element 45 has in turn a plurality of holes 47 for letting out the electrolytic solution, for example three sets of holes which are again distributed in a uniform manner over the entire length of the chromium-plating anode 12.

The tubular element 45 of the chromium-plating anode, in its bottom part, is surrounded by a chamber 48 for the distribution of electrolyte solution and balancing of the pressure, which is connected to one of the pumps 15 of the tank 14, by means of the piping 16. The chamber 48 consists, for example, of lead plates which, similar to the tubular element 45, are connected to the positive-polarity bars 49 which fed the current to the said anode.

More particularly, in the example shown, the tubular element 45 is supported by two side baffles 50 which separate the closed bottom chamber 48 for distributing the electrolytic solution to the openings 46 for entry of the electrolytic solution into the tubular element 45 of the anode, from an upper chamber 51 which is open upwards and provided on a wall thereof with an overflow hole 52 for forming a sufficient head of the chromium-plating solution above the said tubular element 45.

Whereas the upper chamber 51 has the function of collecting the electrolytic solution which flows out from the upper holes 47 of the tubular element 45 so as to discharge it by overflowing through the hole 52 on the bottom of the chromium-plating chamber 10, the lower chamber 48 forms a kind of "plenum" or pressure equalizing chamber which allows uniform distribution of the electrolytic solution at the entry holes 46, ensuring in this way that the electrolytic solution maintains, over the whole length of the anode, a flow directed in a uniform manner from the bottom upwards, transversely with respect to the anode itself, namely directed substantially in a direction perpendicular to the travel direction of the bar 19, encircling the two opposite sides of the bar. A tile-shaped deflector 53 is located inside the chamber 48 so as to deviate the incoming flow of solution and avoid the occurrence of preferential flows, while a thermometer T2 checks the temperature of the electrolyte which flows through the anode.

The pressure inside the chamber 48 for distribution of the electrolyte solution, the number and the dimensions of the entry holes 46 and the exit holes 47 may vary from case to case and must be suitably calculated so as to ensure gentle entry of the electrolyte solution and consequently homogeneous distribution thereof inside the tubular element 45, substantially devoid of intense turbulent movements which would cause irregular deposition of chromium. The flow of the electrolyte from the bottom upwards, in the direction in which the hydrogen bubbles may develop, caused by the electrolytic chromium-plating process, is nevertheless such as to facilitate the entrainment and escaping of the said bubbles through the upper holes 47.

We shall now describe below the continuous chromium-plating method according to the invention, which can be implemented by means of the apparatus described above.

The bars 19 which are to be plated are connected mechanically and electrically in succession, for example by means of intermediate joints which can be screwed into corresponding threaded holes formed at the opposite ends of the bars 19; in this way, the bars may be fed towards the chromium-plating apparatus, imparting to them also a rotation about their longitudinal axis, with predefined speeds of translation and rotation depending on the dimensions and/or the diameter of the said bars to be plated.

Therefore the bars, as they advance with a constant speed, pass through the sliding contact 27 and then, after the degreasing device 28 where they are impinged by a jet of cleaning liquid, for example water containing a surfactant, pass through the washing tank 29.

In particular, as shown in the example according to FIG. 6, the degreasing device 24 consists of a closed tank 60 containing, on the bottom, a quantity of detergent liquid 61 which, by means of a pump 62 and a pipe 63, is continuously supplied to a spraying head 64 positioned above the bar 19. The bar 19 enters and leaves the degreasing tank 60 through suitable openings formed on the two side walls in positions axially aligned with the openings for allowing the bar to pass into the chromium-plating chamber 10, with suitable sealing gaskets 65 and 66 being provided, as shown.

As previously mentioned, since the bar 19 must be conditioned thermally in order to prevent excessive overheating thereof due to the current circulating inside the bar itself, in order to keep it at a temperature suitable for chromium-plating operation, cooling air jets 30 are provided prior to the degreasing device 24. Moreover, in the case where the temperature of the degreasing liquid 61 increases, exceeding a value considered to be dangerous, a suitable cooling coil 67 may be provided within the degreasing tank 60, immersed in the liquid 61, having, circulating inside it, a cooling fluid, for example water from a fluid source 68, with suitable temperature control means, for example a thermal probe for controlling the temperature of the fluid 61, being provided.

After the degreasing device 24, the bar 19 is made to pass through the washing tank 29 where the bar is struck by water jets which clean it completely before it enters into the front interspace 22 where the bar is impinged by air jets 24 again designed to keep the bar cooled and dry it before it enters into the chromium-plating chamber 10.

Continuing its movement, inside the chromium-plating chamber 10, the bar 19 is first impinged by a jet of electrolytic solution supplied by the pump 17 to the spraying head 18.

This finely divided jet of electrolytic solution which strikes the bar, owing to the known phenomenon of current reverse and the pressure of the jet itself, causes a slight surface corrosion of the surface of the bar necessary for allowing firm fixing of the first layer of chromium when it is deposited inside the anode or the first anode 12 of the apparatus.

Since the nature of the material of the bar or elongated member 19 to be plated may vary and since the surface corrosion treatment may depend, not only on the chemical nature of the electrolytic solution, but also on other factors such as for example the temperature of the solution itself and the impact pressure of the various jets against the surface of the bar to be plated, suitable pressure control means will be provided for varying the pressure and/or the flow rate of the solution supplied by the pump 17 and also for maintaining adequately controlled temperature conditions.

After the surface corrosion zone, the bar enters into the anode 12 or into the first of a set of anodes 12, inside each of which, owing to the electrogalvanic effect, a layer of chromium is plated, said layer having a predefined thickness depending essentially on the parameters of the chromium-plating process and in particular on the linear feeding speed of the bars 19, the ratio between the diameter of the said bar and the internal diameter of the tubular element 45 of the chromium-plating anode, as well as the surface density of current supplied to the bar by the same anodes.

In this connection it is possible to operate with high current densities, ranging, for example, between 150 and 500 $A/dm^2$ or higher, and in order to maintain at the same time high travel speeds of the bars, for example of between 10 and 30 meters/hour, the internal diameter of the tubular element 45 is advantageously slightly greater than the external diameter of the bar 19, for example greater by about 5–20%, since an excessive space between the bar and the anode has a negative effect on the chromium-plating process.

A small distance between the outer surface of the bar 19 and the inner surface of the tubular element 45 of the chromium-plating anode, in addition to allowing operation at much higher amperages and higher travel speeds of the bar, also allows a more regular deposition of chromium due to the fact that the flow of electrolytic solution is distributed homogeneously over the entire length of the chromium-plating anode, maintaining a direction from the bottom upwards; finally, the chromium-plating and productivity conditions may be improved as a result of the bar cooling effect, which is obtained in a controlled manner by regulating or varying the flow rate of the electrolytic solution, by means of a supply pump with a variable delivery.

Since entry holes 46 are located on the bottom surface of the bar 19, while the exit holes 47 are located on the upper surface, and since the pressure of the electrolytic solution inside the compensation chamber 46 is equal to or slightly higher than atmospheric pressure, a very gentle circulation of the electrolytic solution inside the chromium-plating anode is obtained, which prevents the occurrence of intense turbulence which could cause irregular deposition of chromium.

The electrolytic solution which flows out from the top holes 47 collects inside the overflow chamber 51 from where it flows over through the hole 52, collecting on the bottom of the chromium-plating chamber 10 so as to return again into the storage tank 14.

After the anode or the set of chromium-plating anodes 12, the bar 19, continuing its forwards travel, enters into the rear interspace 23 where it is impinged by air jets 25 which, in addition to keeping the bar cooled, cause separation of the film of the electrolytic solution adhering to the said bar.

Upon leaving the chromium-plating chamber 10, the bar is made to pass through a washing tank with water jets 31 and is then dried and kept continuously cooled by further air jets 33. The bar then advances along the exit rollerway 34 from where it is then unloaded laterally along the chute 36 so as to be immersed in the cooling tank 35.

The general diagram shown in FIG. 1 illustrates the use of three chromium-plating electrodes 12 which are arranged in succession; however, the number of electrodes could also vary with respect to that shown; the use of three electrodes with a length of about 33 cm in general proves to be advantageous, since it reduces the risks of contact with the bars 19 caused by any bending of the bar itself. Therefore, depending on the number of anodes used, it will be possible to obtain, in a single pass, deposition of one or more superimposed layers of chromium, the thickness of which will depend essentially on the temperature conditions, on the flow rate of the electrolyte which passes through the anode or each anode, and on the internal diameter of the anode itself. Therefore, depending on the applicational requirements, the apparatus may be set up so as to regulate in a varied manner the temperature and the flow of electrolyte in each anode, for example by regulating the delivery of the pumps 15 so as to vary the bar cooling and chromium-plating conditions.

The possibility of performing continuous chromium-plating in several layers, by means of a single pass, according to the present invention is extremely important since the hairline fractures which may occur during deposition of a chromium layer are closed and covered by the successive chromium deposition; moreover it drastically reduces the process times since it is no longer necessary to perform successive passes for the same bar through a chromium-plating apparatus, as is at present necessary in the case of the apparatus of the known type in order to obtain greater chromium-plating thicknesses.

Moreover the present invention, compared to conventional apparatus, has the advantage of maintaining the circulation of extremely small quantities of electrolytic solution, of the order of a few tens of liter per minute, as against the thousands of liters of electrolytic solution which are required in conventional chromium-plating apparatus. In this way a substantial saving in energy and extremely low process costs are achieved.

From what has been described and illustrated in the accompanying drawings, it will therefore be understood that a method and an apparatus for the continuous chromium-plating of metal bars, tubular elements and the like has been provided, said method and apparatus being extremely versatile and using an original anode structure which is able to allow precise control of the chromium-plating conditions, for the controlled deposition of one or more chromium-plating layers on the same bar, as the latter advances through the said anode and/or anodes.

The possibility of controlling the bar cooling conditions inside each anode, and therefore the chromium-plating conditions, by means of a controlled circulation and a longitudinal distribution of the electrolytic solution as it flows transversely from the bottom upwards in each chromium-plating anode, also allows operation with much higher current densities—in any case higher than those possible with conventional plants, thereby increasing the productivity.

In this connection, considering the high current densities which are made possible with the method and the apparatus according to the invention, with values which may vary from 150 to 400 A per $dm^2$ of surface area to be plated, according to another aspect of the invention, a special joint providing a mechanical and electrical connection between adjacent bars has been provided, said joint being suitable for allowing an electrical contact over a wide surface area and the flow of high current densities for chromium-plating; the joint in question also allows the compensation of any lack of evenness in the butt connection of the bars to be joined together. In this way it is possible to eliminate or reduce greatly the problems associated with overheating of the conventional joints which sometimes caused problems of fusion and consequent welding thereof to the end of the bars to be plated.

According to the present invention, in order to sequentially connect together mechanically and electrically the bars to be plated, an intermediate joint member made of deformable metallic material is used, comprising contact surfaces facing the end of the bars, made of deformable metallic material, for example copper, aluminium or other suitable metallic material having a hardness degree less than that of the said bars to be plated.

The connection joint essentially consists of a cylindrical core, having the same diameter or cross-sectional area as the bars to be plated and provided at its ends with suitable connection means engageable and disengageable by rotation, engaging with corresponding connection means provided or formed at the opposite ends of the bars to be joined together.

Figure 7:
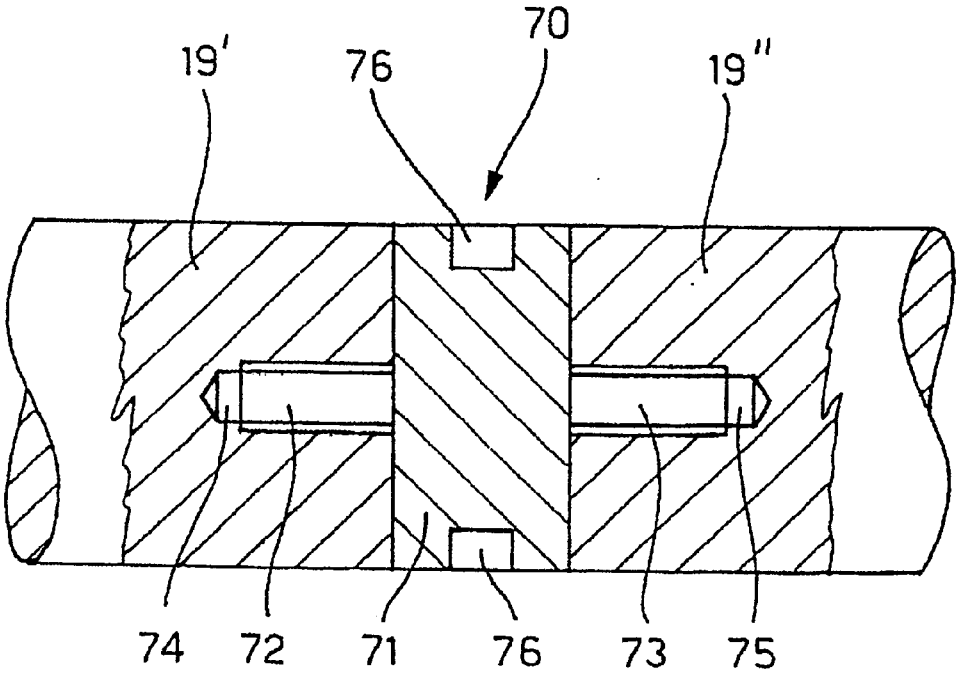
FIG. 7 is a longitudinal sectional view of a first embodiment of a connecting joint for the bars to be plated by means of the apparatus according to FIG. 1.
Figure 8:
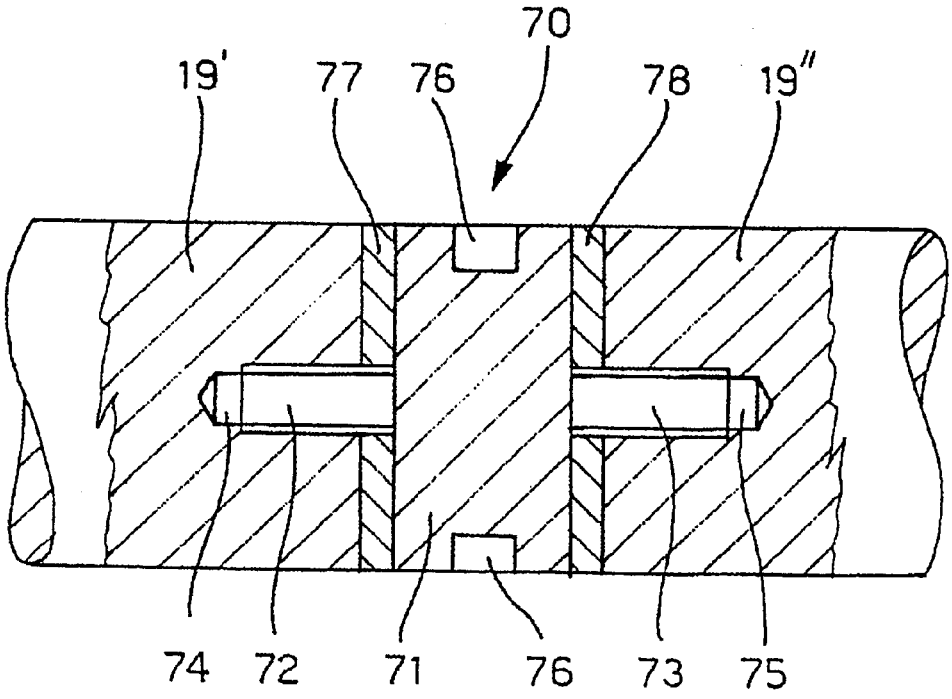
FIG. 8 is a longitudinal sectional view of a second embodiment of a connecting joint.

The connection means may be of any suitable type; two possible embodiments of the joint are shown in the examples according to FIGS. 7 and 8.

In FIG. 7, 70 denotes a first joint according to the invention for connecting two bars 19' and 19" to be plated. The joint 70 comprises a central core 71 having the same diameter or the same transverse dimensions as the bars 19' and 19" and with, projecting from it, two threaded pins 72, 73 having opposite right-hand and left-hand threads which are able to be screwed into corresponding threaded holes 74, 75 formed axially in the opposite ends of the two bars 19' and 19".

Since the bars 19' and 19" may in turn have errors in the butt joint or evenness at their ends which, with the conventional connection systems, would cause a contact in restricted zones through which an excessively high current density would pass, such as to produce intense localised overheating and welding as a result of fusion of the ends in contact with the said bars, according to the present invention a joint comprising a central core made of soft material is used, said material having a hardness less than that of the steel bars to be plated and for example consisting of copper, aluminium or other material suitable both for conducting the electric current and undergoing a partial plastic deformation by means of compression during tightening of the joint so as to come into close contact and for forming a suitable fit against the end surface of the two bars to be joined together.

In order to facilitate screwing and final tightening, it is possible to envisage in the central core 71, the formation of flat surfaces or holes 76 for engagement with a tightening key.

Other solutions which are able to achieve the same result are obviously possible. A second solution is shown in FIG. 8, in which the same reference numbers have been used to indicate similar or equivalent parts; the solution shown in FIG. 8 differs from the preceding solution in that a washer 77, 78 made of copper, aluminium or other deformable metallic material has been arranged between the central core 71 of the joint and the opposite ends of the two bars 19' and 19"; in this case the core 71 may be made of steel since the fit and electric contact between the surfaces is ensured by the intermediate washers.

The two preceding figures show a screw connection between the central core and the ends of the bars to be connected together; other solutions, involving other mechanical and electrical fastening systems, are possible however.

Figure 9:
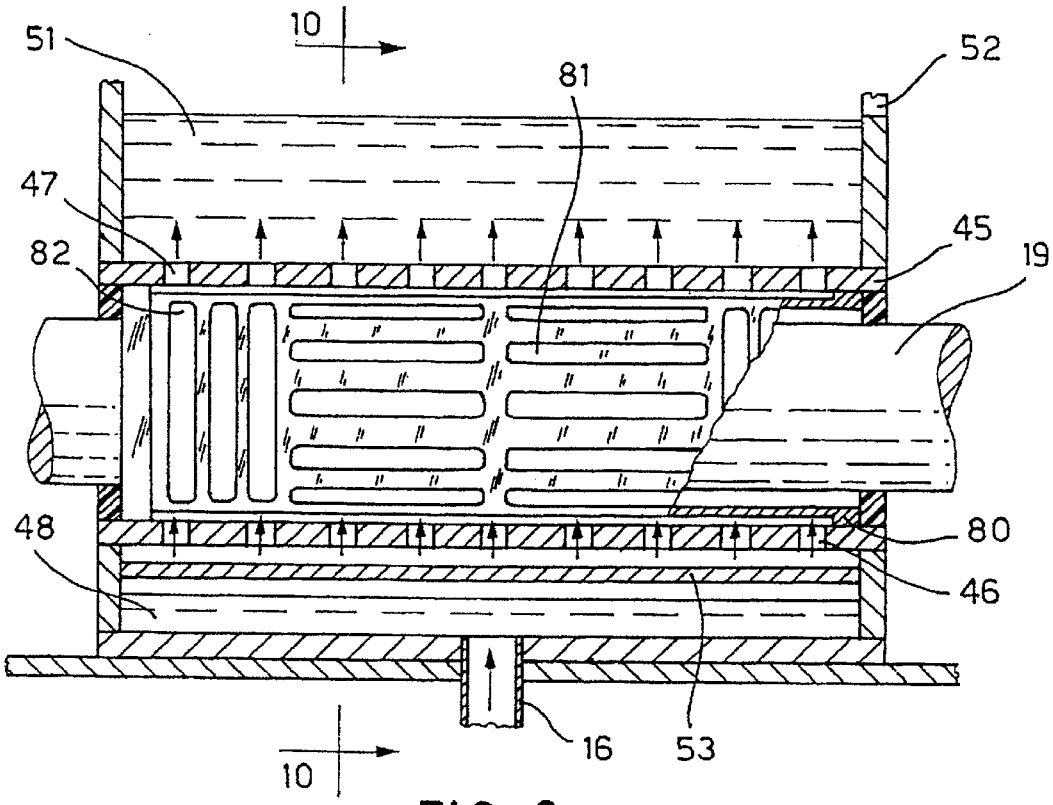
FIG. 9 is a longitudinal sectional view, similar to that of FIG. 3, illustrating a further improvement to the apparatus according to the invention.
Figure 10:
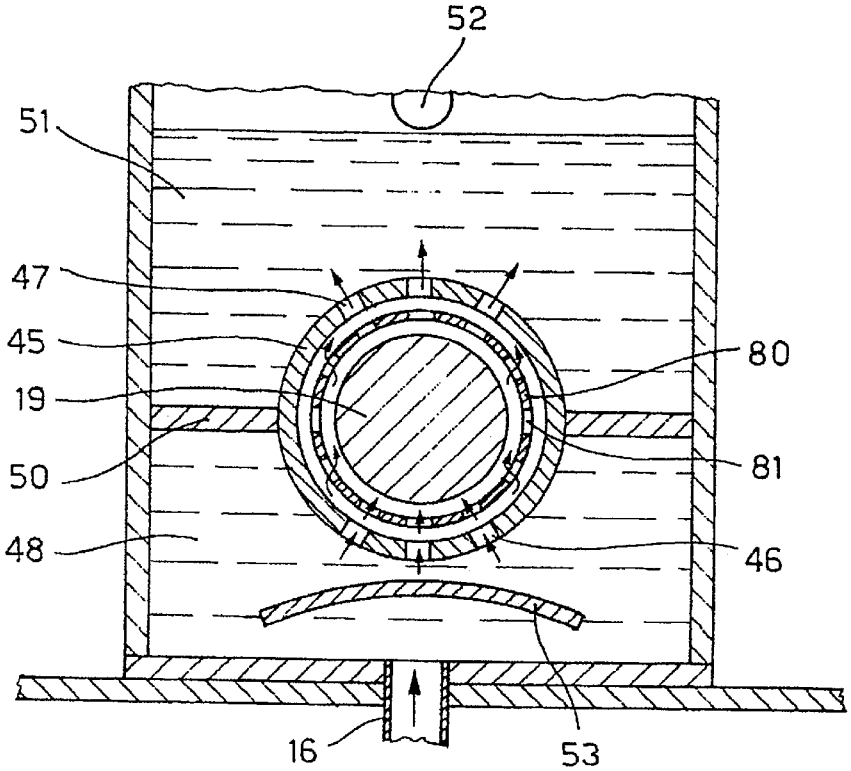
FIG. 10 is a cross-sectional view along the line 10—10 of FIG. 9.

FIGS. 9 and 10 show a further improvement to the apparatus according to the preceding figures; the same reference numbers are therefore used for similar or equivalent parts.

In certain cases, for example when a bar 19 to be plated bends slightly or is not perfectly straight, or more generally when the space between the external surface of the bar 19 and the internal surface of the tubular element 45 of the anode is excessively reduced, random electrical discharges may occur and damage the surface of the plated bar.

In such cases it is possible to arrange between the bars 19 and the tubular element 45 of the chromium-plating anode a bored sleeve 80 which is made of plastic or electrically non-conducting material and which extends over the whole length of the anode. The sleeve 80 is provided with broad through-holes for the electrolytic solution, for example long longitudinal holes 81 and/or transverse holes 82, as shown. The dimensions, the shapes and number of holes may be of any kind provided that they are suitable for allowing free movement of the electrolytic solution upwards and around the bar, without hindering the flow thereof.

It is understood, however, that that which has been stated and illustrated with reference to the accompanying drawings has been provided purely by way of a non-limiting example of the general features of the method, the anode structure and the apparatus which are claimed.

What is claimed is:

1. Method for the continuous chromium-plating of elongated members according to which an elongated member to be plated is advanced through at least one tubular-shaped chromium-plating anode into which an electrolytic solution is made to flow so as to allow the deposition of at least a layer of chromium on the bar as the latter is advanced through the anode, characterized by the steps of:

supplying the electrolytic solution along the length of the chromium-plating anode by axially distributing a flow of electrolytic solution from the bottom to upwards, transversely with respect to the advancing direction of the elongated member, and circulating the electrolytic solution through the chromium-plating anode, in a controlled condition and in a quantity sufficient for keeping the elongated member at a substantially constant chromium-plating temperature while the same elongated member is advanced into the electrolytic solution along the chromium-plating anode.

2. Method according to claim 1, characterized by cooling the elongated member upstream and downstream of the chromium-plating anode, by impinging air jets.

3. Method according to claim 1, characterized by performing a surface corrosion of the elongated member upstream of the chromium-plating anode by means of a pressurised jet of electrolytic solution.

4. Method according to claim 1, characterized by performing the layered deposition of chromium by feeding the elongated member through at least a first and a second axially aligned chromium-plating anodes, while maintaining independent, temperature controlled, chromium-plating conditions in each anode.

5. Method according to claim 4, characterized by varying the thickness of one chromium layer or of each chromium layer, by varying the temperature of the elongated member, changing the quantity of electrolytic solution circulated inside the anode or inside each anode.

6. Method according to claims 4, characterized by varying the thickness of one chromium layer or of each chromium layer, by varying the internal diameter of the chromium-plating anode with respect to the outer diameter of the elongated member.

7. Method according to claim 1, characterized by providing said chromium-plating anode with a set of holes axially spaced along the bottom surface and the upper surface, respectively of the anode for circulation of the electrolytic solution from the bottom upwards, transversely with respect to the anode itself, and maintaining a constant pressurised condition of the electrolytic solution in a supply chamber underneath the set of holes of the bottom surface.

8. Method according to claim 7, characterized by maintaining a constant level of electrolytic solution above the holes of the upper surface of the anode.

9. Apparatus for the continuous chromium-plating of elongated members, characterized by comprising:

a chromium-plating chamber longitudinally extending in a moving direction of the elongated members to be plated, said chamber having opposite side walls provided with aligned openings for the passage of the elongated members;

at least one tubular anode axially aligned with the inlet and outlet openings for the passage of the elongated member provided at the opposite side walls of the chromium-plating chamber;

an auxiliary tank containing a fresh electrolytic chromium-plating solution;

electrolytic solution supplying means for axially distributing the electrolytic solution by transversely flowing the solution with respect to the chromium-plating anode, while maintaining a flow direction inside the anode from the bottom upwards; and temperature control means for maintaining the elongated member at a uniform and substantially constant chromium-plating temperature, over the length and inside the said chromium-plating anode.

10. Apparatus according to claim 9, characterized by comprising at least a first and a second tubular chromium-plating anodes, axially aligned along a path for the elongated members inside the chromium-plating chamber, and independent electrolytic solution distributing and pumping means for circulating said electrolytic solution in a controlled manner transversely with respect to each chromium-plating anode.

11. Apparatus according to claim 9, further characterized by comprising spraying means for spraying the electrolytic solution onto the elongated members, inside said chromium-plating chamber, upstream the chromium-plating anodes.

12. Apparatus according to claim 11, characterized in that said spraying means comprise a spraying head connected to a pumping device for supplying the electrolytic solution.

13. Apparatus according to claim 12, characterized in that said pumping device is of variable delivery type.

14. Apparatus according to claim 9, characterized in that an interspace for cooling the elongated members by air jets is provided upstream and downstream of the chromium-plating chamber.

15. An apparatus for the continuous chromium-plating of elongated members according to claim 9, in which the elongated members are mechanically and electrically connected together by an intermediate connection joint, characterized in that said connection joint comprises a central core having a diameter or cross-dimensions corresponding to those of the elongated member to be plated and in that the end surfaces of the central core, are made of metallic material having a hardness lesser than that of the said central core and elongated members.

16. Apparatus according to claim 15, characterized in that the central core comprises axially extending threaded pins screwing into threaded holes in the opposite ends of the elongated members.

17. Apparatus according to claim 15, characterized in that said central core of the connection joint is made of deformable metallic material.

18. Apparatus according to claim 15, characterized in that a washer of deformable metallic material is provided at each end of the central core.

19. Apparatus according to claim 9, characterized by comprising a bored sleeve of electrically insulating material between the elongated member and the tubular anode.

20. Apparatus according to claim 19, characterized in that the insulating sleeve axially extends over the entire length of the anode.

21. Apparatus according to claim 19, characterized in that the insulating sleeve is provided with longitudinally and/or transversely extending holes.

22. Apparatus according to claim 9, characterized in that the tubular anode is extending between 30 and 40 cm.

23. Anode structure for use in an apparatus according to claim 9, characterized by comprising a tubular element for receiving the elongated members to be plated, said tubular element having a plurality of axially spaced passing through holes over its bottom and upper surfaces to communicate the inside of the tubular element with a respective chamber for the electrolytic solution and balancing of the pressure, underneath and above the tubular element of the anode.

24. Anode structure according to claim 23, characterized in that said chambers comprises said surface of the tubular element inside a chamber.

25. Anode structure according to the claim 23, characterized in that said tubular element has an internal diameter greater by 5–20% than the outer diameter of the elongated members.

26. Anode structure according to the claim 23, characterized by comprising a casing having internal partitions for supporting the tubular element between the bottom chamber and the upper chamber of the anode structure.

27. Anode structure according to claim 23, characterized in that a flow deflector is provided in the lower chamber, facing the inlet apertures at the bottom surface of the tubular element.

28. Anode structure according to claim 23, characterized by comprising a temperature control device for controlling the temperature of the electrolyte.

* * * * *